US005324225A

United States Patent [19]

Satoh et al.

[11] Patent Number: 5,324,225

[45] Date of Patent: Jun. 28, 1994

[54] INTERACTIVE TOY FIGURE WITH SOUND-ACTIVATED AND PRESSURE-ACTIVATED SWITCHES

[75] Inventors: Yasuta Satoh, Nagareyama; Shigehiro Tanaka, Ichikawa; Yoshio Katoh, Omiya, all of Japan

[73] Assignee: Takara Co., Ltd., Tokyo, Japan

[21] Appl. No.: 798,597

[22] Filed: Nov. 26, 1991

[30] Foreign Application Priority Data

Dec. 11, 1990 [JP] Japan ..... 2-402886

[51] Int. Cl.[5] ..... A63H 3/28; A63H 11/00

[52] U.S. Cl. ..... 446/175; 446/298; 446/353

[58] Field of Search ..... 446/175, 352, 356, 353, 446/359, 368, 297, 303, 298, 390, 156, 158, 278, 361, 330, 354, 362

[56] References Cited

U.S. PATENT DOCUMENTS

| | | | |
|---|---|---|---|
| 3,384,074 | 5/1968 | Rautiola et al. | 446/297 X |
| 4,228,793 | 10/1980 | Ramey | 128/33 |
| 4,231,184 | 11/1980 | Corris et al. | 446/175 |
| 4,289,307 | 9/1981 | Marshall, Jr. et al. | 272/52.5 |
| 4,451,911 | 5/1984 | Klose et al. | 446/303 X |
| 4,571,208 | 2/1986 | Saigo et al. | 446/353 |
| 4,687,456 | 8/1987 | Wang | 446/158 |
| 4,696,653 | 9/1987 | McKeefery | 446/303 X |
| 4,903,424 | 2/1990 | Satoh et al. | 40/414 |
| 4,973,286 | 11/1990 | Davison | 446/175 |

FOREIGN PATENT DOCUMENTS

| | | | |
|---|---|---|---|
| 940276 | 12/1948 | France | 446/353 |

*Primary Examiner*—Mickey Yu
*Attorney, Agent, or Firm*—Price, Gess & Ubell

[57] ABSTRACT

An interactive novelty figure includes a housing having an external configuration that can simulate, for example, an animal. A plurality of switch assemblies is located about the housing and are obscured within its exterior configuration to respond to certain predetermined stimuli, such as pressure and sound. A sound-generating circuit and a motor for moving an appendage member, attached to the housing, is provided within the housing. Different sounds, characteristic of the animal, can be provided in response to both pressure and audio commands. The appendage member can further comprise a pair of parallel elongated members that can flex to provide a life-like wagging motion.

22 Claims, 4 Drawing Sheets

INTERACTIVE TOY FIGURE WITH SOUND-ACTIVATED AND PRESSURE-ACTIVATED SWITCHES

BACKGROUND OF THE INVENTION

1. Field of the Invention

The present invention relates to an interactive toy figure, such as a plush figurine simulating an animal and more particularly to a toy figure that is responsive to different stimuli to create both sound and movement features for the amusement of the observer.

2. Description of Related Art

Interactive toy figures and novelty well known in the prior art and have the capacity to respond to different stimuli and produce different sounds. For example, in U.S. Pat. No. 4,289,307, a model hobby horse is disclosed having switches that can detect motion and, depending upon the type of motion, can produce different horse-like sounds. U.S. Pat. No. 4,451,911 discloses an electronic doll with a series of switches about the doll housing that can provide different stored vocal messages in response to operation by a user.

U.S. Pat. No. 4,903,424 discloses a novelty item that can take the form of an artificial plant or doll which will move in response to sound. U.S. Pat. No. 4,228,793 discloses a pressure switch operated vibrating unit that can be inserted within a stuffed animal and activated by the exertion of pressure.

U.S. Pat. No. 3,387,074 discloses an animal doll figure for producing a low-frequency sound and having switches that are activated by the close proximity of a human or an animal.

The prior art device are usually relative expensive and frequently incorporate sophisticated technology to increase the interest of the user. For example, dolls have been proposed with limited degrees of voice recognition and with a capacity to provide responding audible messages.

There is still a need in the prior art to provide a real life simulated figurine having multiple audible and movable features that will provide a highly amusing and pleasant sensation of owning a real animal, such as a dog or cat.

SUMMARY OF THE INVENTION

The present invention is directed to an interactive toy figure, for example, in the form of a feline having an interframe support with an exterior housing configured to simulate a live animal. A plurality of switch assemblies are located about the simulated body of the animal and are obscured within its exterior configuration. The switch assemblies can be responsive to different predetermined stimuli, such as a sound-activated switch and a pressure-activated switch. The housing can be provided with a speaker and drive circuit to provide characteristic sounds of the animal. An appendage, such as a tail, can be connected to the housing in a cantilevered manner. The appendage member can be articulated to simulate the animal's tail with life-like wagging movements. The appendage member can comprise a pair of flexible elongated members connected at one end of the appendage member and relatively movable in a parallel manner to provide a compound motion of pivotal movement about the other end in a contracting and extending movement to simulate a wagging movement of the appendage member.

One of the pressure sensitive switches can be positioned on the back of the animal and another pressure sensitive switch can be positioned on the front or throat of the animal. Depending upon the activation of the specific switch, a pleasing "Mew" sound or a purring sound can be activated along with a wagging of the appendage tail. Additionally, a sound sensor can be provided so that the animal will respond to an audio input, again, to provide a combination of sound simulating an animal response, such as "meow", and movement. A motor, such as a DC motor with appropriate gearing, can be utilized to drive the wagging movement of the tail and to also power a circuit for interconnecting the sound and pressure activated switch assemblies with a sound generator circuit.

Preferably the exterior configuration of the housing includes a fabric envelope covering that is appropriately padded and sculptured to produce both the look and feel of an animal, such as a cat or a dog, in a manner that the observer will find highly enjoyable.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a realistic novelty figure that responds to various stimuli.

In the preferred embodiment, the present invention is disclosed in the form of a feline cat or a kitten as an interactive toy or novelty figure. In this embodiment, the location of the various pressure sensitive switches have been specifically designed to be placed in the locations of the simulated feline housing to provide characteristic responses upon touch of a human operator. Additional simulated animal figures can be utilized with an appropriate rearrangement of the position of the pressure switch assemblies, again, to be located in the traditional places that such an animal would respond to a human touch.

Figure 1:
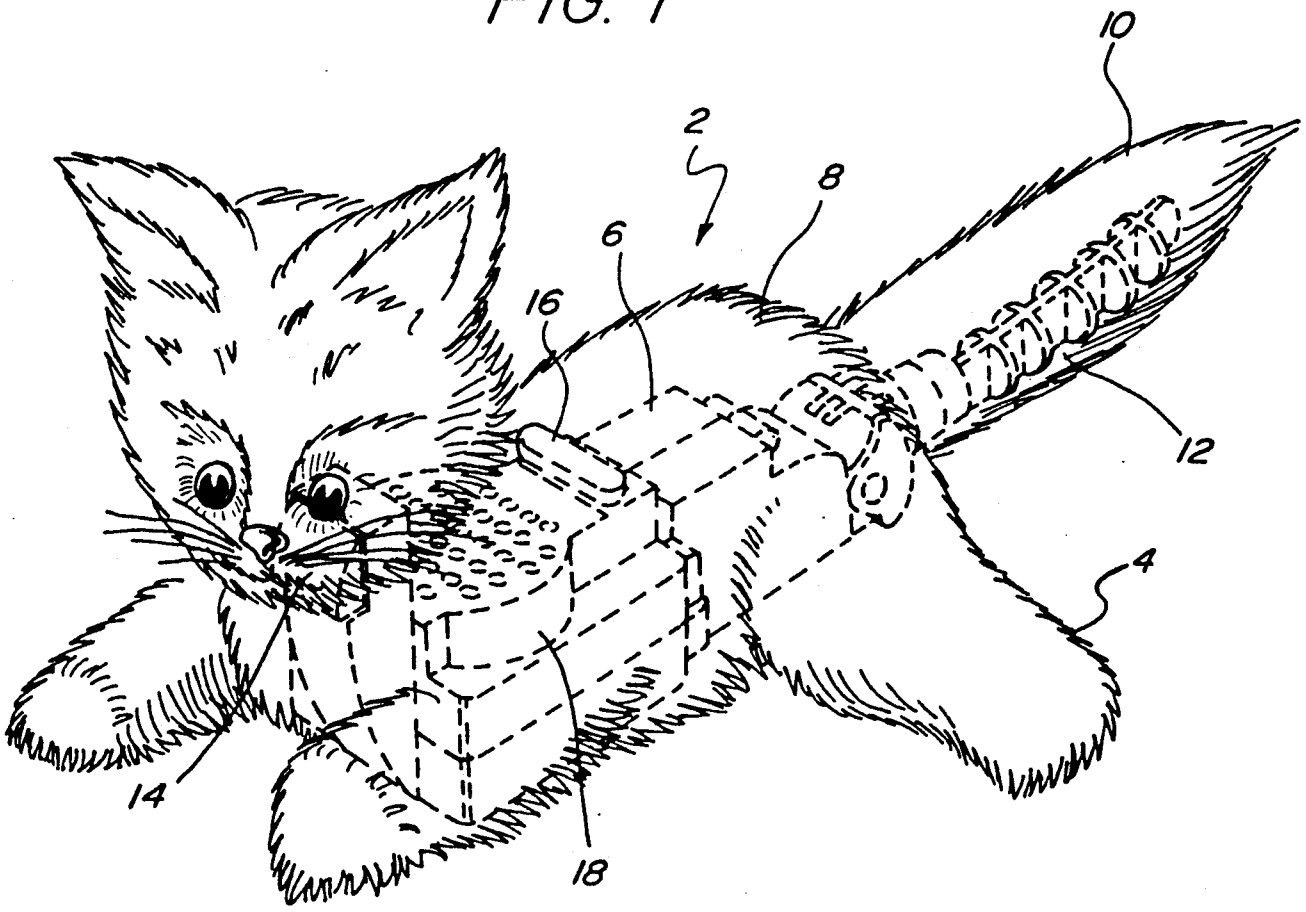
FIG. 1 is a perspective view disclosing the interactive toy figure of the present invention.

Referring to FIG. 1, the interactive toy figure can take the form of a feline 2, such as a kitten. The housing 4 can include an internal housing or frame 6, seen in phantom lines. An outer envelope covering 8 can be subjectively configured, for example, in the form of a kitten, and preferably is made from a flexible fabric that can be covered with simulated hair. The outer covering 8 can include appropriate padding and structural supporting members to provide a realistic configuration and positioning of the component of parts and appendages of the feline configuration. In the preferred embodiment, the outer covering 8 is permanently adhered to the internal housing 6, but alternative embodiments can provide a removable outer covering to enable cleaning or even a replacement to provide a different configuration of a grown cat or a different color or breed of kitten. Preferably, the kitten is extremely life-like to supplement the purposes of the present invention.

The kitten can have a tail 10 which acts as an appendage member from the internal housing 6. Extending within the tail 10 is a cantilevered assembly 12 that is articulated and assembled to provide a reciprocating movement when appropriately driven. Thus, the cantilevered assembly 12 can simulate an animal's tail and the movement can simulate a life-like wagging movement. As can be appreciated, other appendaged portions of the simulated animal, such as the head and paws, could also be driven. The cantilevered assembly of the present invention, however, is specifically appropriate to provide a compound motion through a pair of flexible elongated members shown, for example, in FIGS. 4 and 5. Thus, the cantilevered assembly 12 is capable of providing a compound motion of a pivotal movement about the connection of the internal housing 6 and a contracting and extending movement to simulate a wagging movement of the appendage member. A pressure-activated switch assembly 14 is located in a forward portion of the internal housing 6 within the exterior configuration of the housing 4. The outer covering 8 extends over the pressure-activated switch 14 which is positioned at approximately the throat or neck area of the feline 2. Another pressure-activated switch assembly 16 is also mounted on the internal housing 6 and obscured within the exterior configuration of the outer covering 8 across the feline back. As can be readily understood, patting, scratching, or petting a kitten's back generally produces a favorable response, such as a meowing sound and a corresponding movement or wagging of a tail 10. Also, scratching or petting a kitten's throat frequently produces a purring sound. The switches 14 and 16 are appropriately mounted so that they will be responsive to a pressure stimuli of the operator at characteristic locations on the feline body that would produce a response from a kitten. The internal housing 6 also carries a speaker 32 which is mounted beneath the appropriate grill assembly 18.

Figure 2:
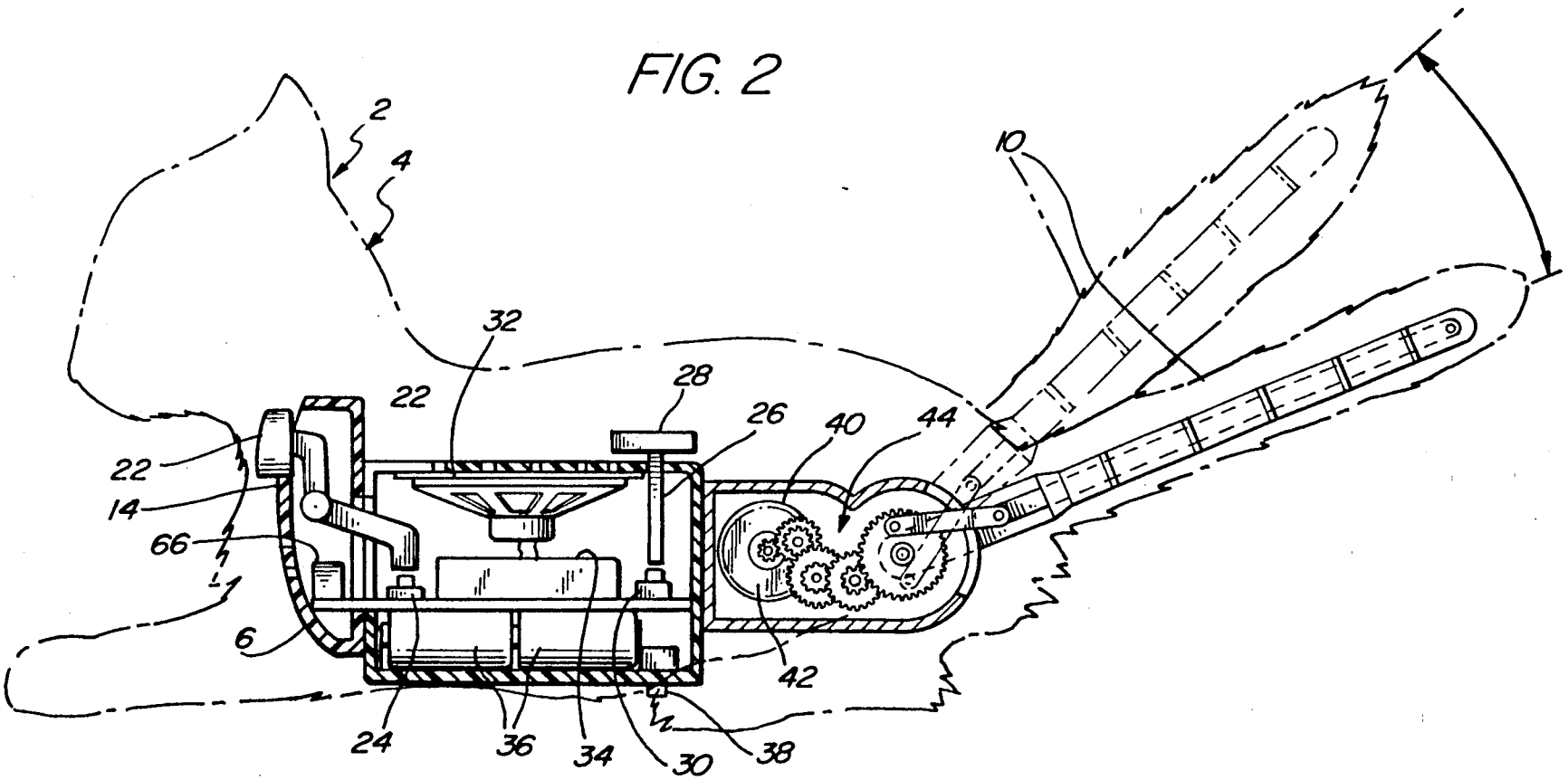
FIG. 2 is a schematic cross-sectional view of one preferred embodiment of the present invention.

Referring to FIG. 2, a schematical cross-sectional view of the animal is disclosed. The pressure-activated switch assembly 14 can include a pivotally mounted push lever 20 with a pressure plate 22 at one end of the lever 20 and a pressure-activated switch 24 at the other end. The pressure-activated switch assembly 16 can include a pushing rod 26, again with a pressure plate 28, journalled within the internal housing 6 to contact a pressure switch 30. The internal housing 6 can be divided into an upper cavity for receiving a speaker 32 and an appropriate circuit assembly, such as a printed circuit board 34, and a lower cavity for receiving batteries 36 and mounting the main power switch 38. While not shown, the outer covering 8 can have a flap for interfacing with a Velcro fastener to permit operator access to the battery compartment and the main switch, while permitting the flap in the outer covering to be closed with the Velcro fastener to continue the simulated appearance of the feline across its underside.

A swinging unit 40 extends from the rear as a portion of the internal housing 6 and can house an appropriate DC motor 42, capable of driving a gear transmission assembly 44. An output power gear 46 carries an eccentric pin 48 which in turn is connected to a connecting rod 50. The connecting rod 50 is journalled within the swinging unit 40 to provide an axial movement along the direction of the appendage member 52. The appendage member includes an elongated flexible tail core, or tail housing member 54, and a flexible strip member 56 which is capable of reciprocating relative to the flexible tail core 54 by the crank motion of the eccentric pin 48 driving the connecting rod 28. The end of the flexible strip 56 is fixed to the flexible tail core 54, for example, by a screw 58.

Figure 4:
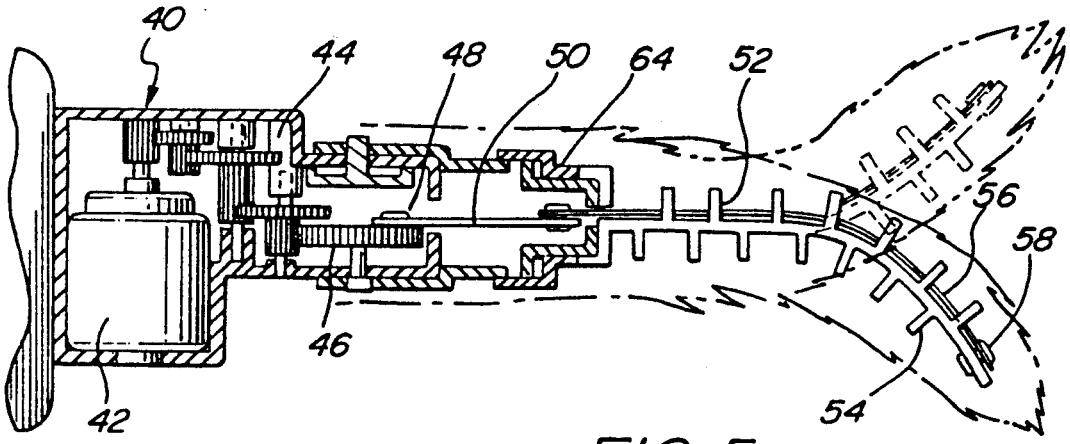
FIG. 4 is a cross-sectional view of the drive assembly of the appendage of the present invention.
Figure 5:
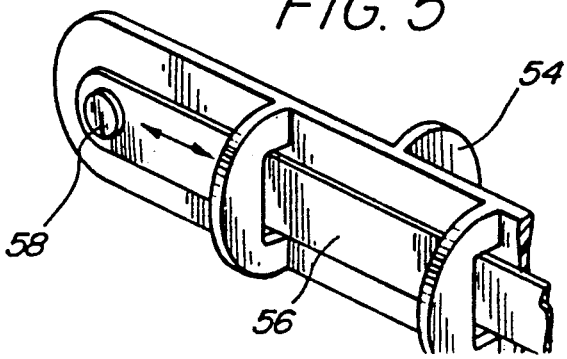
FIG. 5 is a perspective view of the elongated flexible members that constitute the appendage member of the present invention.

Reference can be had to FIG. 4, which is basically a bottom view of the appendage member, and FIG. 5 to disclose the operative movements. The tail core 54 has a plurality of spacer members 60 that extend on either side of a planar base to provide a substance feel to the feline tail 10. An elongated opening extends axially through the tail core 54 and is of a size to receive the flexible strip 56. As mentioned above, the flexible strip 56 is fixed to the tail core 54 at its outer end and the flexible strip 56 is connected to the connecting rod 50 at the other end. When the connecting rod 50 is driven by the power gear 46, the flexible strip member 56 reciprocates in a parallel direction relative to the axis of the flexible tail core 54. As a result of this reciprocating pulling and pushing movement, a pivoting motion is provided to the tail 10 and it bends so that the tip of the tail appears to curl in and out in a life-like, wagging movement as a result of the articulated configuration of the appendage member 52. Thus, a concave position is alternatively produced on each side of the tail 10 during a wagging movement.

Figure 3:
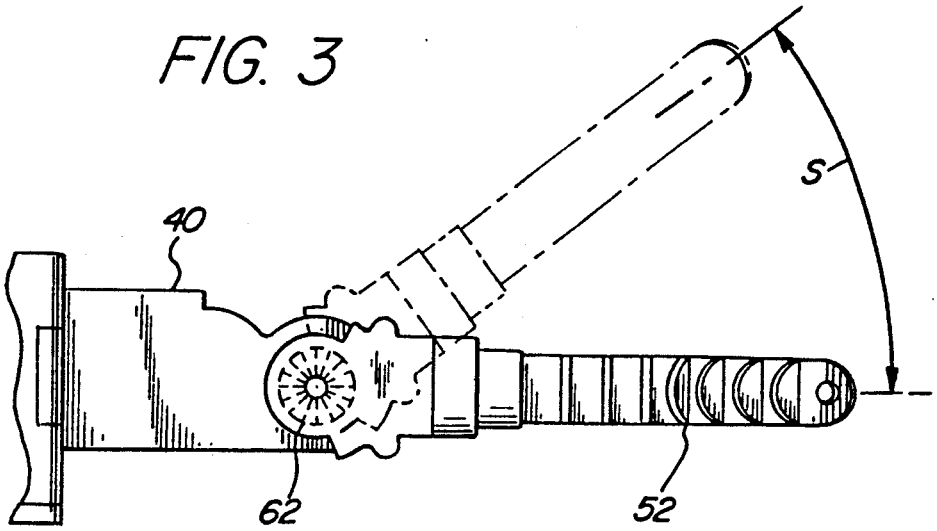
FIG. 3 is a partial schematic view of an appendage mechanism for utilization in a preferred embodiment of the present invention.

Referring to FIG. 3, a vertical side view of the appendage member 52 is disclosed. An adjustable mechanism for varying the vertical position of the appendage member 52 is disclosed wherein an angle of movement S for the flexible tail core 54 can be provided as a result of an adjustment of an index disk 62. The index disk 62 has a serrated face which can frictionally cooperate with a toothed face on a cylindrical connecting member 64. A spring can bias the index disk 62 against the toothed face of the connecting member 64 to provide a check stop movement for indexing the position of the tail 10. Thus, the operator can raise or lower the tail 10 in a vertical plane while the tail 10 will be driven in a reciprocating manner in a horizontal plane.

We have previously disclosed the respective pressure-activated switch assemblies 14 and 16 that are mounted at appropriate locations on the simulated animal housing 4. A sound sensor 66 can be mounted in the forward portion of the housing 6 beneath the push lever 20. The sound sensor 66 is basically a microphone that can detect sound of a certain level to activate both the sound generator 70 and the drive motor 42. When the sound sensor 66 is activated, a third sound effect can be produced which is a variation of the basic "Mew"

sound. This sound "Mew" is characteristic of the animal's response to a vocal request, such as the name of the pet.

Figure 6:
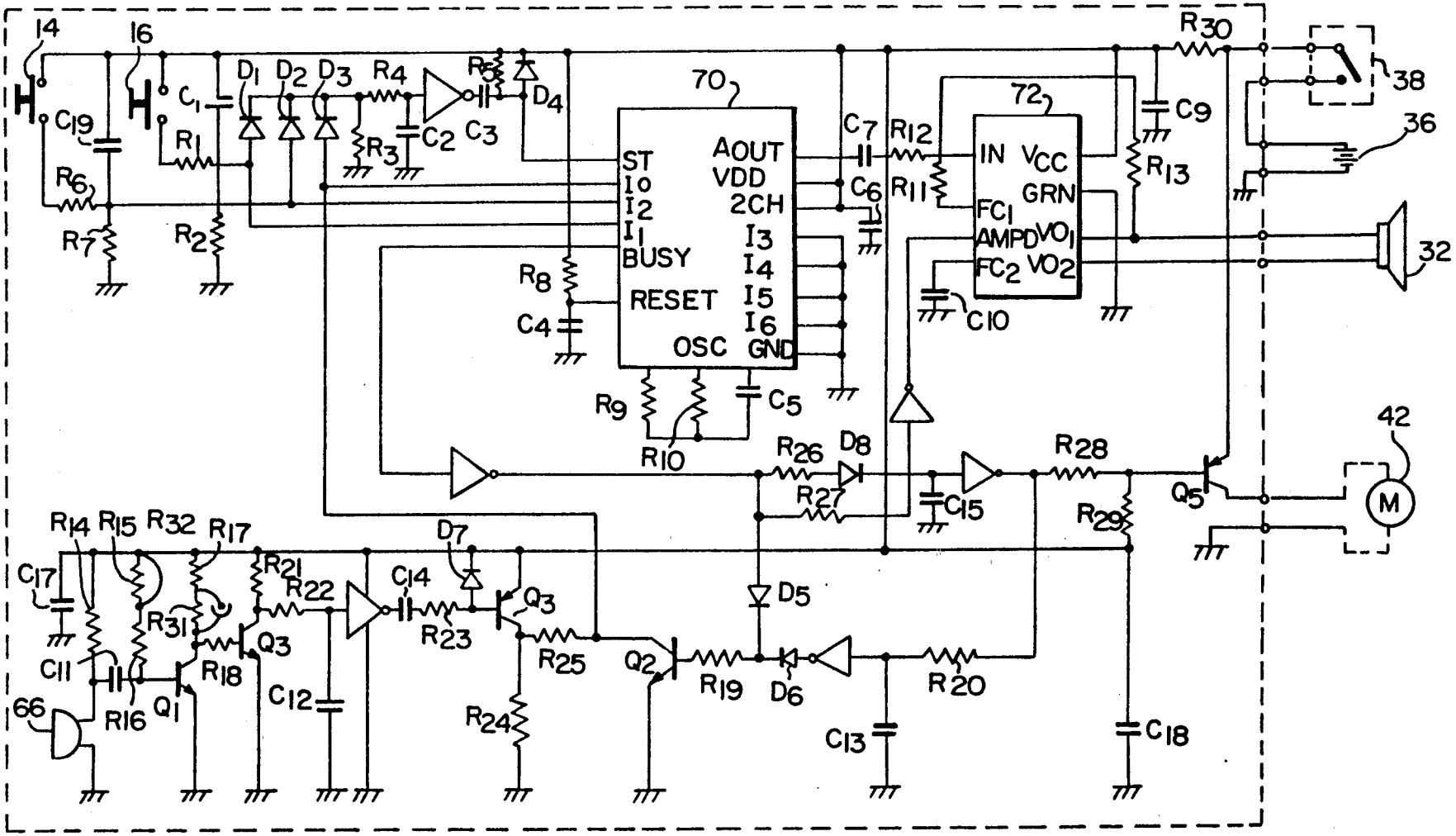
FIG. 6 is an electronic schematic of the drive circuit.

Referring to FIG. 6, a schematic diagram of the electronics of a preferred embodiment is shown, along with the battery 36, speaker 32, sound sensor 66, and switches 14 and 16, to which the electronics are coupled. A sound-synthesizing chip 70 is programmed to generate specific sounds in response to the input of the switches 14 and 16 and the sound sensor 66 to appropriately drive the speaker 32 via an amplifier chip 72. A suitable sound synthesizing chip is sold by Oki Electric Industry Co., Ltd. under part no. MSM6372. A suitable amplifier chip 72 is manufactured by Motorola, Inc. and sold under part no. MC34119.

As shown, an analog out line ("A-out") from the sound synthesizing chip 70 drives the amplifier chip 72 which in turn drives the speaker 32.

An electric voltage (+B) is supplied to the control circuit by an electric source 36 via a main switch 38. If the sound sensor 66 detects an external sound, then a transistor Q4 is turned on, causing the electric voltage (+B) to be applied to a port $I_0$ of the sound synthesizing chip 70 and causing a "Mew" sound to be output. If the back-touching switch 16 is activated, then the electric voltage (+B) is applied to a port $I_1$ of the sound synthesizing chip 70, causing a different "meow" sound to be output. If the throat-touching switch 14 is activated, the and the electric voltage (+B) is applied to a port $I_2$ of the sound synthesizing chip 70, causing a "purring" sound to be output.

In either of the above three cases, a signal output by a "Busy" port of the sound synthesizing chip 70 causes a transistor Q5 to turn on and thereby activate the motor 42.

In operation, activation by an operator of, for example, the push lever 20, will contact the switch 24 and cause the speaker 32 to emit a pleasing purring sound from the sound generator along with an activation of the DC motor 42 to create the life-like wagging motion of the appendage tail 10. A conventional timing circuit, activated by the input switches, will ensure that the motor 42 and the sound generator will continue to run for a predetermined short period of time after activation. Activation of the push rod 26 will again activate the DC motor 42 and cause the speaker 32 to emit a meowing sound from the sound generator. If the human operator speaks, or if there are other sound producing environmental condition, then the sound sensor 66 will be activated to also drive the DC motor 42 to provide the life-like wagging movement of the tail appendage 10 while producing a third characteristic sound of "Mew" through the speaker 32. As can be readily appreciated, different combinations of movement and sounds, characteristic of the animal, can be provided through the various switch mechanisms.

The combination of a pressure or tactile switching assembly with a sound switch assembly provides a highly pleasing and life-like response from the simulated animal.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An interactive toy figure comprising:

a housing having an exterior configuration;

a plurality of switch assemblies located about the housing and obscured within the exterior configuration and responsive to certain predetermined stimuli, including at least one sound activated switch assembly and one pressure activated switch assembly;

sound producing means for providing sound within the housing;

movement producing means for providing movement to at least a portion of the housing;

circuit means for interconnecting the sound and pressure activated switch assemblies with the sound producing means and the movement producing means to provide an activation of one or more of the sound producing and movement producing means depending on the specific switch assembly that has been activated; and an appendage member extending in a cantilevered manner from the rest of the housing, including a pair of flexible elongated members connected at one end of the appendage member and relatively movable to provide a compound motion of pivotal movement about the other end, the appendage member being articulated and connected to the movement producing means to provide a reciprocating wagging movement when activated of an alternating concave configuration.

2. The toy figure of claim 1 further including a second pressure activated switch assembly, the second pressure activated switch assembly providing a different sound and the same movement as the sound activated switch assembly.

3. The toy figure of claim 1 wherein the housing includes an interior support frame for mounting the sound producing means and a soft outer covering member with simulated hair extending about the housing and having a simulated appearance of an animal.

4. The toy figure of claim 1 wherein the appendage member simulates an animal's tail and the movement producing means simulates a life-like wagging movement.

5. The toy figure of claim 1 wherein the appendage member simulates an animal tail and the housing includes an interior support frame for mounting the sound producing means and a soft outer covering member with simulated hair extending about the housing and having a simulated appearance of an animal.

6. The toy figure of claim 1 wherein the exterior configuration of the housing simulates a feline and the sound producing means provides a characteristic feline sound.

7. The toy figure of claim 6 further including a second pressure activated switch assembly, the second pressure activated switch assembly providing a different sound and the same movement as the sound activated switch assembly.

8. The toy figure of claim 7 wherein the sound producing means provides a first sound of a meowing characteristic of a cat and second sound of a purring characteristic of a cat and one of the pressure activated switch assemblies activates one sound and the other pressure activated switch assembly activates the other sound.

9. The toy figure of claim 8 wherein the circuit means includes a timing circuit to provide a predetermined activation of the movement producing means and sound producing means.

10. The toy figure of claim 9 wherein one pressure activated switch assembly includes a push rod lever and the other pressure activated switch assembly includes a pivotally mounted lever for respective activation by an operator.

11. The toy figure of claim 10 wherein the push rod lever is mounted beneath the soft outer covering member in a portion of the housing simulating a back of the cat and the pivotally mounted lever is mounted beneath the soft outer covering member in a portion of the housing simulating a throat of the cat.

12. An interactive toy animal figure comprising:

a housing having an exterior configuration of a soft exterior covering simulating a life-like appearance of an animal, including an appendage member as a portion of the housing extending in a cantilevered manner from the rest of the housing, the appendage member including a pair of flexible elongated members connected at one end of the appendage member and relatively movable to provide a compound motion of pivotal movement about the other end;

movement producing means within the housing to provide movement to the appendage member, the appendage member being articulated and connected to the movement producing means to provide an alternating concave configuration; when activated to simulated movement of an animal tail;

a plurality of switch assemblies located about the housing and obscured within the exterior configuration and responsive to certain predetermined stimuli, including at least one sound activated switch assembly and one pressure activated switch assembly;

sound producing means for providing sound within the housing that is characteristic of the simulated animal, and circuit means for interconnecting the sound and pressure activated switch assemblies with the sound producing means and the movement producing means to provide an activation 13. The toy figure of claim 12 wherein the flexible elongated members are movable in a relative sliding movement to simulate wagging movement of the appendage member.

14. The toy figure of claim 13 further including a second pressure activated switch assembly, the second pressure activated switch assembly providing the same sound and movement as the sound activated switch assembly.

15. The toy figure of claim 14 wherein the sound producing means provides a first sound of a meowing characteristic of a cat and second sound of a purring characteristic of a cat and one of the pressure activated switch assemblies activates one sound and the other pressure activated switch assembly activates the other sound.

16. The toy figure of claim 15 wherein the circuit means includes a timing circuit to provide a predetermined activation of the movement producing means and sound producing means, one pressure activated switch assembly includes a push rod lever and the other pressure activated switch assembly includes a pivotally mounted lever for respective activation by an operator, one pressure activated switch mounted on a portion of the housing simulating a back of the animal and the other pressure activated switch is mounted on a portion of the housing simulating a throat of the animal.

17. A toy figure comprising:

a housing having an exterior configuration including an appendage member as a portion of the housing extending in a cantilevered manner from the rest of the housing; the appendage member being articulated, the appendage member includes a pair of flexible elongated members connected at one end of the appendage member and relatively movable to provide a compound motion of pivotal movement about the other end and an alternating concave configuration from one side to the other side to simulate a wagging movement of the appendage member;

movement means for activating the wagging movement including means for moving one elongated member relative to the other elongated member in approximately parallel movement to cause the compound motion, and means for activating the movement means.

18. The toy figure of claim 17 wherein the means for activating includes a plurality of switch assemblies located about the housing and obscured within the exterior configuration and responsive to certain predetermined stimuli, including at least one sound activated switch assembly and one pressure activated switch assembly;

sound producing means for providing sound within the housing, and circuit means for interconnecting the sound and pressure activated switch assemblies with the producing sound means and the movement producing means to provide an activation of one or more of the sound and movement producing means depending on the specific switch assembly that has been activated.

19. The toy figure of claim 18 further including a second pressure activated switch assembly, the second pressure activated switch assembly providing a different sound and the same movement as the sound activated switch assembly.

20. The toy figure of claim 19 wherein the appendage ember simulates a feline tail and the housing includes an interior support frame for mounting the sound producing means and a soft outer covering member with simulated hair extending about the housing and having a simulated appearance of a feline.

21. The toy figure of claim 20 wherein the sound producing means provides a first sound of a meowing characteristic of a cat and a second sound of a purring characteristic of a cat and one of the pressure activated switch assemblies activates one sound and the other pressure activated switch assembly activates the other sound.

22. The toy figure of claim 21 wherein the circuit means includes a timing circuit to provide a predetermined activation of the movement producing means and sound producing means and one pressure activated switch assembly includes a push rod lever and the other pressure activated switch assembly includes a pivotally mounted lever for respective activation by an operator, one pressure activated switch mounted on a portion of the housing simulating a back of the feline and the other pressure activated switch is mounted on a portion of the housing simulating a throat of the feline.

* * * * *